US008978819B2

(12) United States Patent
Fujimoto et al.

(10) Patent No.: US 8,978,819 B2
(45) Date of Patent: Mar. 17, 2015

(54) SPARK ARRESTOR, MUFFLER, AND STRADDLE TYPE VEHICLE

(71) Applicant: Yamaha Hatsudoki Kabushiki Kaisha, Iwata-shi, Shizuoka (JP)

(72) Inventors: Hiroyuki Fujimoto, Shizuoka (JP); Kazuhiro Nishihara, Shizuoka (JP); Keishi Jouzaki, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 14/149,992

(22) Filed: Jan. 8, 2014

(65) Prior Publication Data

US 2014/0360808 A1 Dec. 11, 2014

Related U.S. Application Data

(60) Provisional application No. 61/832,276, filed on Jun. 7, 2013.

(51) Int. Cl.

| | |
|---|---|
| ***F01N 1/08*** | (2006.01) |
| ***F01N 3/02*** | (2006.01) |
| ***F01N 3/06*** | (2006.01) |
| ***F01N 13/08*** | (2010.01) |
| *F01N 3/00* | (2006.01) |
| *F01N 13/00* | (2010.01) |

(52) U.S. Cl.

CPC ..... *F01N 3/06* (2013.01)
USPC ..... 181/231; 181/227; 181/265

(58) Field of Classification Search

CPC ..... F01N 1/08; F01N 1/083; F01N 1/084; F01N 3/02; F01N 3/0212
USPC ..... 181/231, 227, 228, 265, 267
See application file for complete search history.

(56) References Cited

U.S. PATENT DOCUMENTS

| | | | | | |
|---|---|---|---|---|---|
| 1,317,858 | A | * | 10/1919 | Brown | 181/265 |
| 1,447,037 | A | * | 2/1923 | Rea | 181/265 |
| 1,772,589 | A | * | 8/1930 | Beamer | 181/265 |
| 1,866,004 | A | * | 7/1932 | Beamer | 181/265 |
| 3,754,620 | A | * | 8/1973 | Foster et al. | 181/265 |
| 3,884,655 | A | * | 5/1975 | Coop | 96/380 |
| 4,142,607 | A | * | 3/1979 | Landwehr et al. | 181/259 |
| 4,185,715 | A | * | 1/1980 | Reu Boiu | 181/266 |
| 4,645,521 | A | * | 2/1987 | Freesh | 55/309 |
| 4,913,597 | A | * | 4/1990 | Christianson et al. | 406/39 |
| 5,413,189 | A | * | 5/1995 | Browning et al. | 181/268 |
| 5,627,351 | A | * | 5/1997 | Okuma et al. | 181/231 |
| 5,677,518 | A | * | 10/1997 | Fischer et al. | 181/269 |

(Continued)

FOREIGN PATENT DOCUMENTS

JP 2003-184541 A 7/2003

*Primary Examiner* — Edgardo San Martin
(74) *Attorney, Agent, or Firm* — Keating & Bennett, LLP

(57) ABSTRACT

A spark arrestor mounted on a muffler connected to an exhaust pipe of an engine includes a cylindrical portion including an opening that extends therethrough from the outside to the inside thereof, two cap members that respectively close first and second ends of the cylindrical portion, a mesh portion that covers the opening, and a tail pipe extending from the inside to the outside of the cylindrical portion through the cap member, wherein the exhaust flows outside the cylindrical portion in a first direction, and a channel where the exhaust flows in a second direction opposite to the first direction is provided inside the cylindrical portion.

10 Claims, 6 Drawing Sheets

(56) References Cited

U.S. PATENT DOCUMENTS

| | | | | |
|---|---|---|---|---|
| 5,883,342 | A * | 3/1999 | Wolpert | 181/230 |
| 5,969,299 | A * | 10/1999 | Yamaguchi et al. | 181/227 |
| 6,540,046 | B1 * | 4/2003 | Schuhmacher et al. | 181/231 |
| 6,941,751 | B2 * | 9/2005 | Yamamoto et al. | 60/322 |
| 7,174,991 | B1 * | 2/2007 | Gunnarsson et al. | 181/231 |
| 7,434,656 | B2 * | 10/2008 | Yasuda et al. | 181/227 |
| 7,918,310 | B1 * | 4/2011 | Helgeson et al. | 181/218 |
| 2003/0136607 | A1 | 7/2003 | Kawamata et al. | |
| 2011/0198150 | A1 * | 8/2011 | Gorke et al. | 181/264 |
| 2012/0261210 | A1 * | 10/2012 | Kondou | 181/228 |

* cited by examiner

SPARK ARRESTOR, MUFFLER, AND STRADDLE TYPE VEHICLE

BACKGROUND OF THE INVENTION

1. Field of the Invention

The present invention relates to a spark arrestor, a muffler, and a straddle type vehicle.

2. Description of the Related Art

In a straddle type vehicle, such as an ATV (All-Terrain Vehicle) or the like, a spark arrestor that prevents spark discharges to the outside may be provided in a muffler connected to an exhaust pipe of an engine.

Japanese Patent Laid-Open Publication 2003-184541 discloses a technique for performing expansion and contraction of exhaust in a spark arrestor that is mounted to straddle a plurality of expansion chambers provided in a muffler. This technique, however, may lead to a spark arrestor and a muffler that are undesirably large in size in the axial direction thereof.

SUMMARY OF THE INVENTION

In view of the problems described above, preferred embodiments of the present invention provide a spark arrestor, a muffler, and a straddle type vehicle that are small in size while improving the exhaust sound reduction capability and the spark prevention capability.

A spark arrestor according to a preferred embodiment of the present invention is mounted to a muffler connected to an exhaust pipe of an engine and includes a cylindrical portion including an opening therein that extends therethrough from an outside to an inside thereof, two caps that respectively close first and second ends of the cylindrical portion, a mesh portion that covers the opening, and a tail pipe extending from the inside to the outside of the cylindrical portion, wherein the exhaust flows outside the cylindrical portion in a first direction along an axis of the cylindrical portion, and the exhaust flows in a channel of the cylindrical portion in a second direction opposite to the first direction.

A further preferred embodiment of the present invention provides a muffler including the above-described spark arrestor.

An additional preferred embodiment of the present invention provides a straddle type vehicle including the above-described muffler.

According to a preferred embodiment of the present invention, a channel where exhaust flows in the opposite direction is provided inside the cylindrical portion making it possible to ensure a longer length for the entire exhaust channel from the opening of the cylindrical portion to the outlet of the tail pipe, and also to reduce the flow speed of the exhaust in an area where the exhaust flow is bent. As a result, it is possible to reduce the size of the spark arrestor and the muffler while improving the exhaust sound reduction capability and the spark prevention capability.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention will be described with reference to the drawings.

Figure 1:
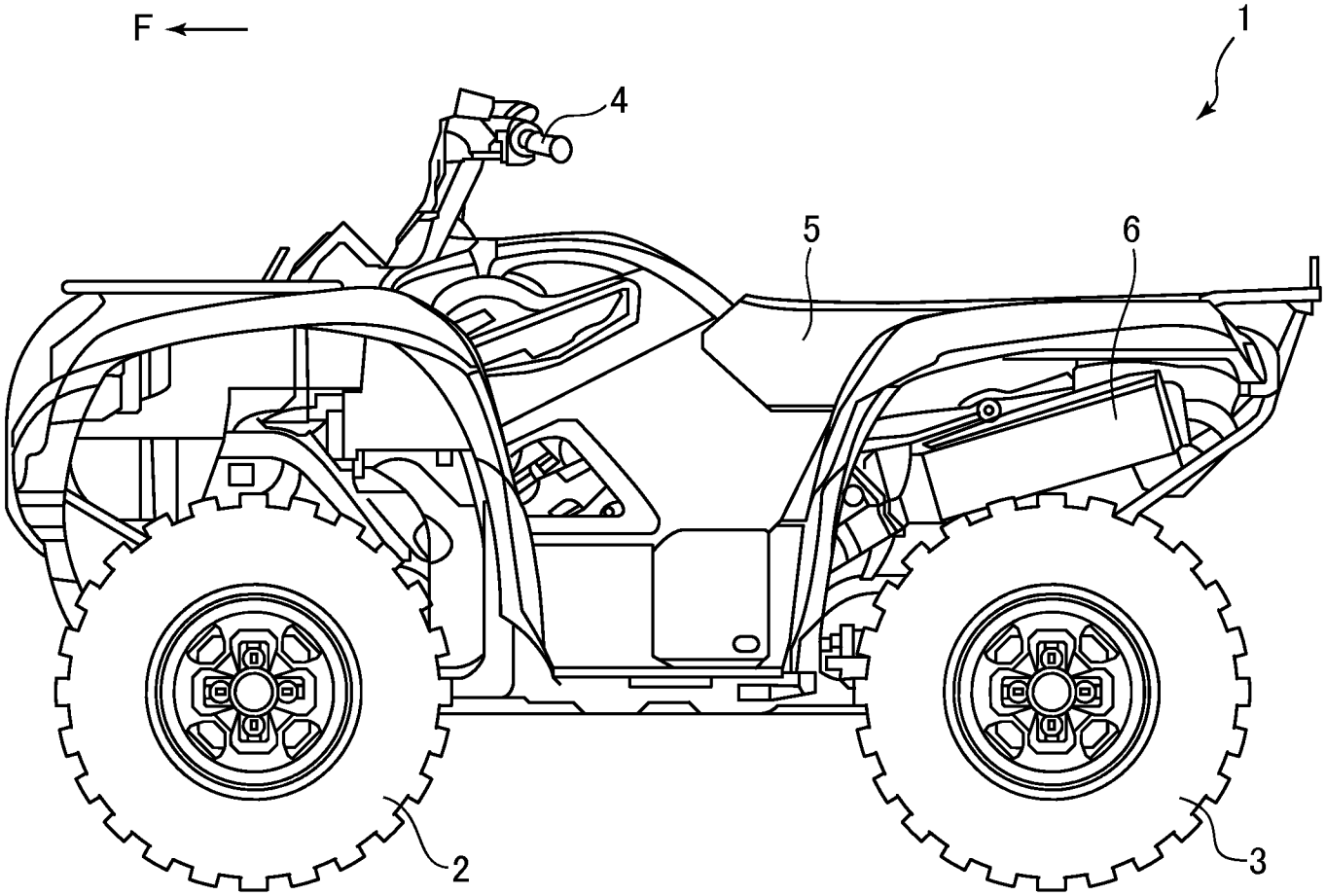
FIG. 1 is a side view of a straddle type vehicle according to a preferred embodiment of the present invention.

FIG. 1 is a side view of a straddle type vehicle 1 according to a preferred embodiment of the present invention. The arrow F in the diagram indicates the forward direction. The straddle type vehicle 1 in the present preferred embodiment is, for example, an ATV (All Terrain Vehicle), which is preferred for running on uneven ground. However, not being limited to the above, the straddle type vehicle 1 may be a motorcycle or the like, for example.

A pair of front wheels 2 spaced apart from each other in the left-right direction are mounted to a lower front portion of the straddle type vehicle 1, while a pair of rear wheels 3 spaced apart from each other in the left-right direction are mounted to a lower rear portion of the straddle type vehicle 1. A handle bar 4 for a driver to operate is mounted in an upper front portion of the straddle type vehicle 1. A seat 5 for a driver to straddle is mounted on an upper rear portion of the straddle type vehicle 1.

A muffler 6 according to a preferred embodiment of the present invention is mounted to a rear lateral portion of the straddle type vehicle 1. The muffler 6 is connected to the rear end portion of an exhaust pipe 59 extending rearward from an engine (not shown). In the present preferred embodiment, the muffler 6 preferably is positioned on the left side of the straddle type vehicle 1, for example.

Figure 2:
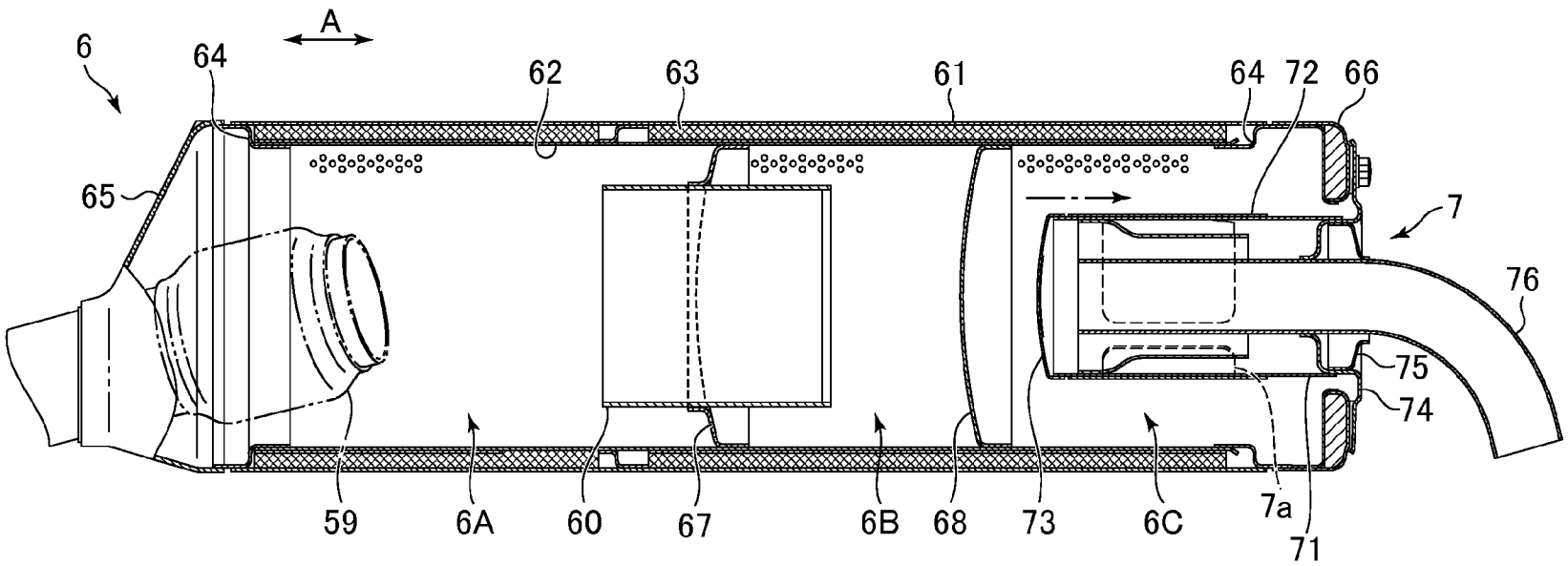
FIG. 2 is a cross-sectional view of a muffler according to a preferred embodiment of the present invention.

FIG. 2 is a cross-sectional view of the muffler 6 according to a preferred embodiment of the present invention. FIG. 2 shows a cross-sectional structure of the muffler 6 sectioned along the up-down direction passing through the central axis of the muffler 6. The arrow A in FIG. 2 indicates the directions along the center axis of the muffler 6 and the spark arrestor 7.

The muffler 6 includes an outer cylindrical member 61, an inner cylindrical member 62, and glass wool 63, in which the inner cylindrical member 62 has a diameter slightly smaller than that of the outer cylindrical member 61 and is mounted on the inner side of the outer cylindrical member 61, and the glass wool 63 is sandwiched between the outer cylindrical member 61 and the inner cylindrical member 62. The outer cylindrical member 61 and the inner cylindrical member 62 are fixed to each other by an annular fastening member 64. Numerous small holes are provided in the inner cylindrical member 62 so that the exhaust inside the muffler 6 is exposed to the glass wool 63.

The front ends of the outer cylindrical member 61 and the inner cylindrical member 62 are covered by a cap member 65. The exhaust pipe 59 extends through the cap member 65 to the inside of the muffler 6. The rear ends of the outer cylindrical member 61 and the inner cylindrical member 62 are covered by a cap member 66. A spark arrestor 7 according to a preferred embodiment of the present invention is removably mounted to the cap member 66. A specific structure of the spark arrestor 7 will be described below.

A plurality of partition members 67, 68 spaced apart from each other in the front-back direction are fixed to the inner circumferential surface of the inner cylindrical member 62. The space inside the muffler 6 is sectioned into a plurality of expansion chambers 6A to 6C by these partition members 67, 68. In the present preferred embodiment, three expansion chambers 6A to 6C are defined by the two partition members 67, 68. These include a first expansion chamber 6A, a second expansion chamber 6B, and a third expansion chamber 6C, in order, from the front.

The rear end portion of the exhaust pipe 59 is arranged inside the first expansion chamber 6A so that exhaust is discharged from the exhaust pipe 59 into the first expansion chamber 6A.

A catalyst pipe 60 that holds a catalyst is mounted in the partition member 67 between the first expansion chamber 6A and the second expansion chamber 6B. The exhaust in the first expansion chamber 6A passes to the second expansion chamber 6B through the catalyst pipe 60. Thus, the exhaust is purified by the catalyst held in the catalyst pipe 60.

Communicating holes (not shown) are provided in the partition member 68 between the second expansion chamber 6B and the third expansion chamber 6C. The exhaust in the second expansion chamber 6B passes to the third expansion chamber 6C through these communicating holes.

The spark arrestor 7 is mounted inside the third expansion chamber 6C. The exhaust in the third expansion chamber 6C passes inside the spark arrestor 7 to be discharged to the outside from the tail pipe 76.

The exhaust discharged from the exhaust pipe 59 to the inside of the muffler 6 flows mainly in a direction toward the rear cap member 66, among the two directions indicated by the arrow A, along the central axis of the muffler 6.

In FIG. 2, the main direction in which the exhaust flows inside the third expansion chamber 6C is indicated by the arrow having an alternate long and short dashed line. The exhaust in the third expansion chamber 6C flows mainly toward the opening 7*a* along the outer surface of the cylindrical member 71 of the spark arrestor 7.

Figure 3:
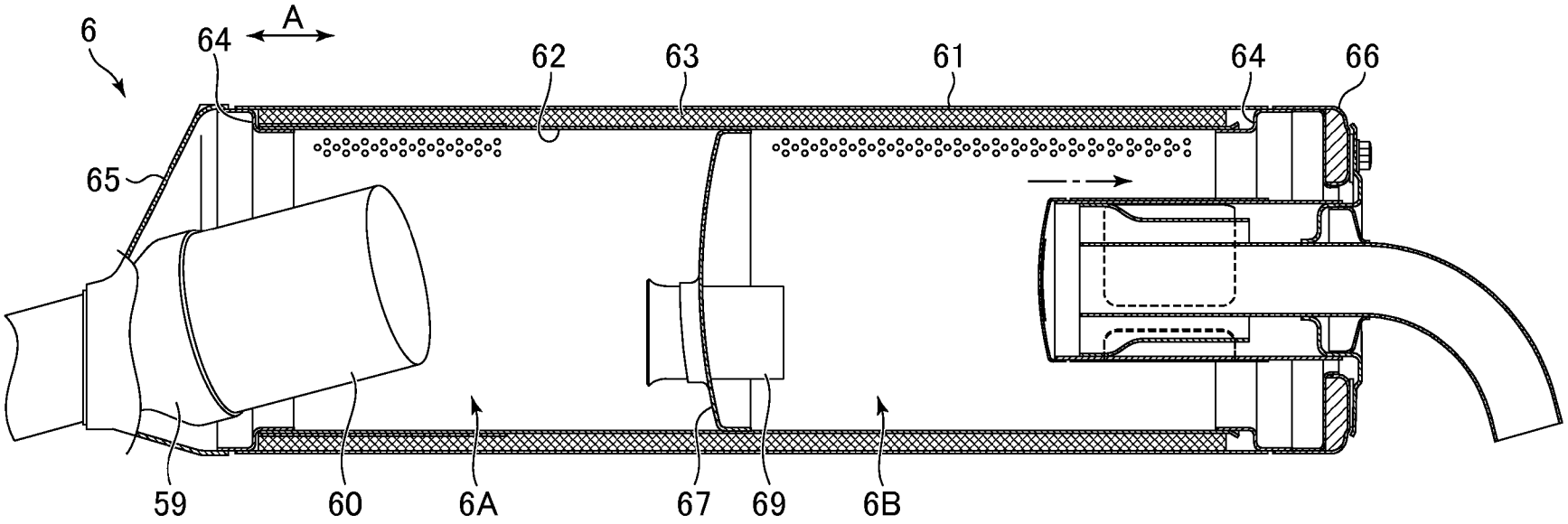
FIG. 3 is a cross-sectional view of a muffler according to another preferred embodiment of the present invention.

Note that the muffler 6 is not limited to the above mentioned preferred embodiment. FIG. 3 is a cross-sectional view of a muffler 6 according to another preferred embodiment of the present invention. The structure that is similar to that described above is given the same reference numerals, and detailed description thereof is partly omitted.

In the present preferred embodiment, the catalyst pipe 60 is mounted in the rear end portion of the exhaust pipe 59. The exhaust from the exhaust pipe 59 passes through and is purified in the catalyst pipe 60, and is discharged into the first expansion chamber 6A.

In the present preferred embodiment, two expansion chambers 6A, 6B are defined by one partition member 67. The exhaust in the first expansion chamber 6A passes through the communication cylinder 69 mounted in the partition member 67 to the second expansion chamber 6B where the spark arrestor 7 is mounted.

The mufflers 6 shown in FIGS. 2 and 3 each include the spark arrestor 7 according to a preferred embodiment of the present invention. The spark arrestor 7 is superior in the exhaust sound reduction capability, as described below. Therefore, in the muffler 6 including the spark arrestor 7, it is possible to simplify and reduce the size of the structure upstream of the spark arrestor 7.

Figure 4:
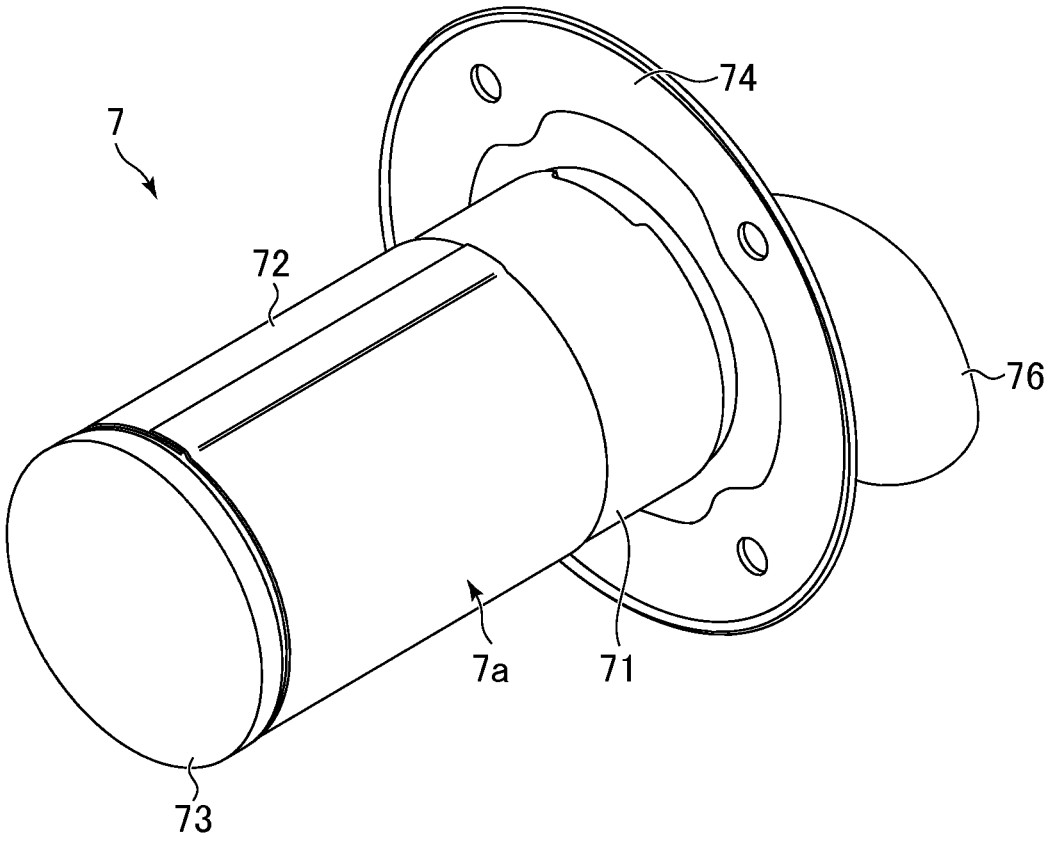
FIG. 4 is a perspective view of a spark arrestor according to a preferred embodiment of the present invention.
Figure 5:
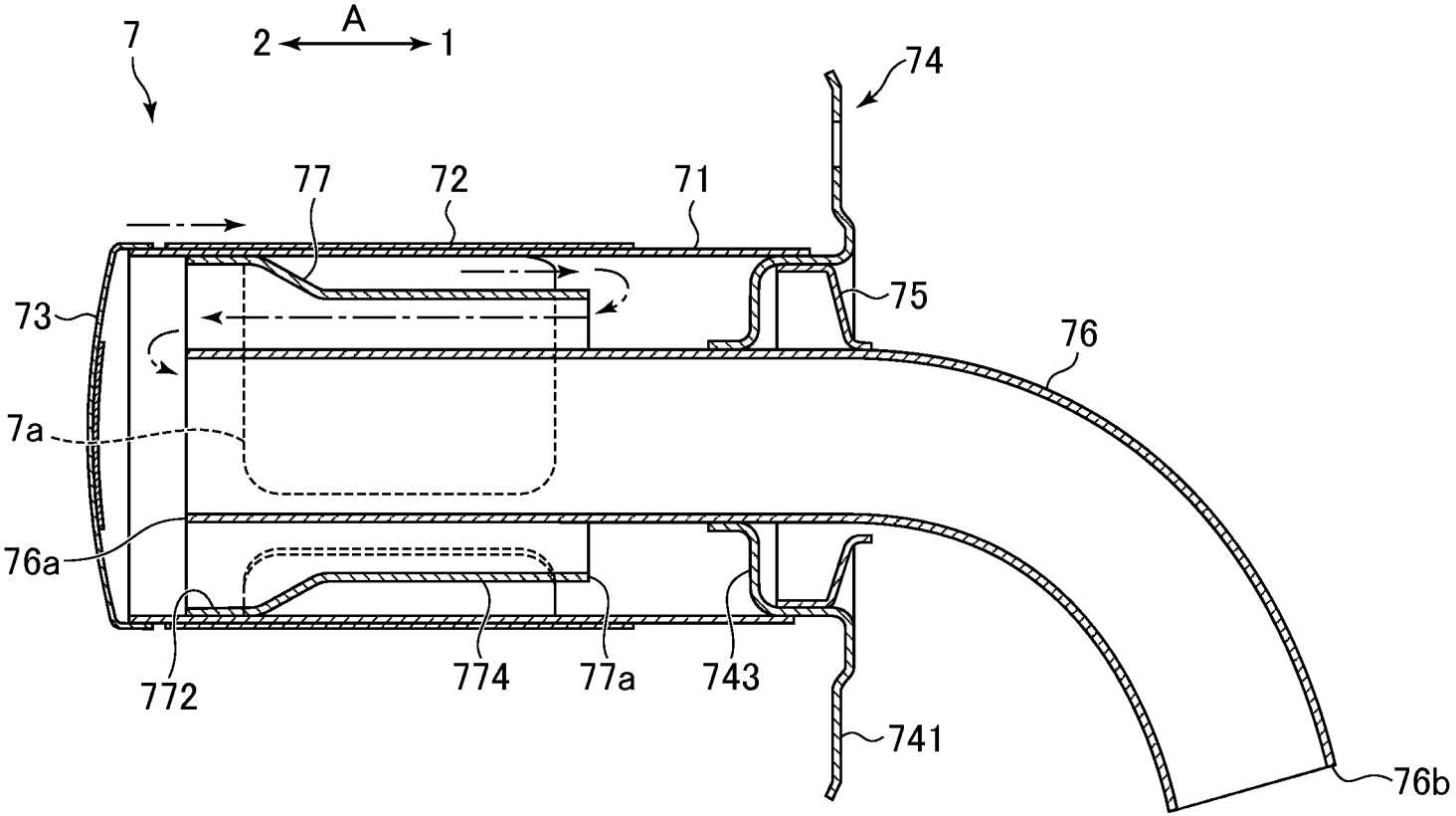
FIG. 5 is a cross-sectional view of a spark arrestor according to a preferred embodiment of the present invention.

FIGS. 4 and 5 are a perspective view and a cross-sectional view, respectively, of the spark arrestor 7 according to a preferred embodiment of the present invention. FIG. 5 shows a cross-sectional structure of the spark arrestor 7 sectioned in the up-down direction passing through the central axis. That is, FIG. 5 is an enlarged diagram of the spark arrestor 7 shown in FIG. 2. The arrow A in FIG. 5 indicates the directions along the central axis of the muffler 6 and the spark arrestor 7, similar to the arrow A in FIG. 2.

The spark arrestor 7 includes a cylindrical member 71 and two cap members 73, 74 that respectively cover both ends of the cylindrical member 71. Below, of the two directions along the central axis of the spark arrestor 7 indicated by the arrow A, the direction toward the cap member 74 relative to the cylindrical member 71 is referred to as a "first direction", while the direction toward the cap member 73 relative to the cylindrical member 71 is referred to as "a second direction".

A plurality of rectangular or substantially rectangular openings 7*a* provided in the cylindrical member 71 are arranged along the circumferential direction thereof. In the present preferred embodiment, three openings 7*a*, for example, are arranged in the circumferential direction preferably having an equidistant interval. The length of the opening 7*a* along the central axis of the spark arrestor 7 is half or substantially half of the length of the cylindrical member 71, for example. In the present preferred embodiment, the opening 7*a* is located at a position closer to the end of the cylindrical member 71 in the second direction than the end in the first direction.

The spark arrestor 7 further includes a cylindrical mesh member 72 covering each opening 7*a* in the cylindrical member 71. The cylindrical mesh member 72 is wound around the outer surface of the cylindrical member 71 and covers all of the openings 7*a*. The cylindrical mesh member 72 is made of, for example, a metal mesh or the like made by crossing metal wires so as to provide sufficiently small mesh relative to the opening 7*a*. Note that the mesh is not shown in FIGS. 4 and 5.

The spark arrestor 7 further includes a tail pipe 76 extending from the inside to the outside of the cylindrical member 71 through the cap member 74. The inlet 76*a* of the tail pipe 76, located inside the cylindrical member 71, is positioned closer to the cap member 73 in the second direction. Specifically, the inlet 76*a* of the tailpipe 76 is positioned farther in the second direction than the opening 7*a* of the cylindrical member 71. Further, the tail pipe 76 is preferably bent downward outside of the cylindrical member 71 with the outlet 76*b* thereof directed downward.

The cap member 74 includes a flange portion 741 having a diameter larger than that of the cylindrical member 71, and an inner circumferential portion 743 positioned on an inner circumferential side of the flange portion 741 and bent toward the second direction in a stepwise manner and inserted into the cylindrical member 71. The flange portion 741 is fixed to the cap member 66 of the muffler 6 (see FIG. 2), and the inner circumferential portion 743 is fixed to the tail pipe 76. Further, an annular supporting member 75 is fixed in the space between the inner circumferential portion 743 and the tail pipe 76.

The spark arrestor 7 further includes a guide member 77 mounted inside the cylindrical member 71. The guide member 77 includes a large diameter portion 772 having a diameter that is equal or substantially equal to that of the cylindrical member 71, and a small diameter portion 774 having a diameter smaller than that of the cylindrical member 71 but larger than that of the tail pipe 76. The large diameter portion 772 is fixed to the inner circumferential surface of the cylindrical member 71 at a position farther in the second direction than the opening 7*a*. The small diameter portion 774 extends from the large diameter portion 772 in the first direction and extends across the shortest path between the opening 7*a* and the inlet 76*a* of the tail pipe 76. Specifically, the tip end 77*a* of the small diameter portion 774 is positioned farther in the first direction than the opening 7*a*.

In FIG. 5, a main direction in which the exhaust flows outside and inside the spark arrestor 7 is indicated by the alternate long and short dashed line. Since the guide member 77 is mounted inside the cylindrical member 71, the exhaust flowing from the opening 7*a* through the mesh member 72 to the inside of the cylindrical member 71 moves along the guide member 77 in the first direction, namely a direction away from the inlet 76*a* of the tail pipe 76.

Then, the exhaust having reached the tip end 77*a* of the guide member 77 reverses the flow direction to move between the guide member 77 and the tail pipe 76 in the second direction, namely a direction approaching the inlet 76*a* of the tail pipe 76. Note that the direction of the exhaust flow is here switched 180 degrees from the first direction to the second direction. In this manner, a channel where the exhaust flows in the second direction is provided inside the cylindrical member 71. The channel is defined by the inner circumferential surface of the guide member 77 and the outer circumferential surface of the tail pipe 76.

Thereafter, the exhaust having reached the inlet 76*a* of the tail pipe 76 reverses the flow direction thereof, flows into the inside of the tail pipe 76 to move again in the first direction, and then is discharged from the outlet 76*b*. Again, the direction of the exhaust flow is here switched 180 degrees from the second direction to the first direction.

According to the present preferred embodiment, since a channel where the exhaust flows in the second direction, namely the direction opposite to the first direction, is provided inside the cylindrical member 71, it is possible to ensure a longer length for the entire channel from the opening 7*a* of the cylindrical member 71 to the outlet 76*b* of the tail pipe 76, and also to reduce the speed of the exhaust flow where the exhaust flow is bent. With the above arrangement, it is possible to improve the exhaust sound reduction capability and the spark prevention capability, and also to reduce the size of the spark arrestor 7 and the muffler 6.

According to the present preferred embodiment, since the outer wall of the tail pipe 76 is used as a portion of the channel where the exhaust flows in the second direction, it is possible to reduce the diameter of the spark arrestor 7.

According to the present preferred embodiment, since the guide member 77 is mounted so as to extend across the space between the opening 7*a* of the cylindrical member 71 and the inlet 76*a* of the tail pipe 76, and the exhaust flow is thus bent, it is possible to ensure a longer length for the entire exhaust channel, and also to reduce the speed of the exhaust flow.

According to the present preferred embodiment, since the guide member 77 guides the exhaust flowing from the opening 7*a* to the inside of the cylindrical member 71 so as to flow in the first direction, namely a direction away from the inlet 76*a* of the tail pipe 76, and the exhaust flow is thus bent, it is possible to ensure a longer length for the entire exhaust channel, and also to reduce the speed of the exhaust flow.

According to the present preferred embodiment, since the opening 7*a* of the cylindrical member 71 is positioned farther in the first direction than the inlet 76*a* of the tail pipe 76, it is possible to ensure a longer length for the entire exhaust channel.

According to the present preferred embodiment, since the tip end 77*a* of the guide member 77 is positioned farther in the first direction than the opening 7*a* of the cylindrical member 71, it is possible to ensure a longer length for the entire exhaust channel.

Figure 6:
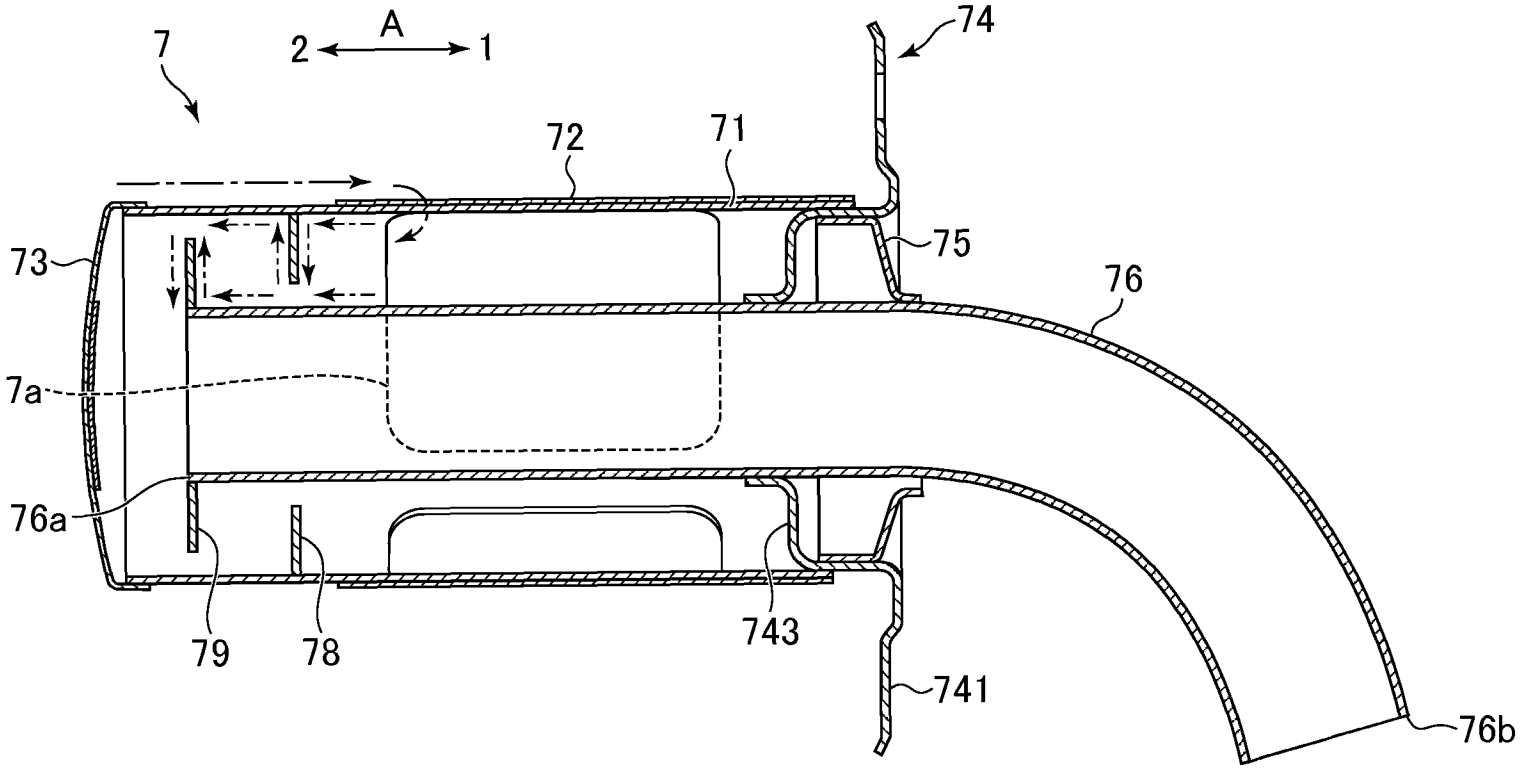
FIG. 6 is a cross-sectional view of a spark arrestor according to another preferred embodiment of the present invention.

Note that the spark arrestor 7 is not limited to the above mentioned preferred embodiments. FIG. 6 is a cross-sectional view of a spark arrestor 7 according to another preferred embodiment of the present invention. The structure that is similar to that in the above preferred embodiments is given the same reference numerals, and a detailed description thereof is partly omitted.

In the present preferred embodiment, the opening 7*a* of the cylindrical member 71 is located at a position closer to the end of the cylindrical member 71 in the first direction than that in the second direction. Accordingly, the distance from the opening 7*a* to the inlet 76*a* of the tail pipe 76 is longer than that in the above described preferred embodiments.

In the present preferred embodiment, the spark arrestor 7 includes a plurality of annular guide members 78, 79 mounted between the opening 7*a* of the cylindrical member 71 and the inlet 76*a* of the tail pipe 76. These guide members 78, 79 are mounted to extend across the shortest path between the opening 7*a* and the inlet 76*a* of the tail pipe 76.

The guide member 78 is fixed to the inner circumferential surface of the cylindrical member 71 such that a small space is provided between the guide member 78 and the outer circumferential surface of the tail pipe 76. Meanwhile, the other guide member 79 is fixed to the outer circumferential surface of the tail pipe 76 such that a small space is provided between the guide member 79 and the inner circumferential surface of the cylindrical member 71.

The guide member 78 fixed to the inner circumferential surface of the cylindrical member 71 and the guide member 79 fixed to the outer circumferential surface of the tail pipe 76 are alternately arranged along the central axis of the spark arrestor 7. Further, the guide member 79 fixed to the outer circumferential surface of the tail pipe 76 has a flange shape at the inlet 76*a* of the tail pipe 76.

In FIG. 6, the main direction in which the exhaust flows outside and inside the spark arrestor 7 is indicated by the arrows having an alternate long and short dashed line. Note that the respective directions of the flows of exhaust inside the spark arrestor 7 in the vicinity of the inner circumferential surface of the cylindrical member 71, the outer circumferential surface of the tailpipe 76, and the surfaces of the guide members 78, 79 are indicated by the arrows having an alternate long and short dashed line.

Since the opening 7*a* of the cylindrical member 71 is positioned farther in the first direction than the inlet 76*a* of the tail pipe 76, the exhaust moving outside the cylindrical member 71 in the first direction reverses the flow direction thereof when flowing into the cylindrical member 71 from the opening 7*a* through the mesh member 72 to move mainly in the second direction, namely a direction approaching the inlet 76*a* of the tailpipe 76. Note that the direction of the exhaust flow here is changed or reversed 180 degrees from the first direction to the second direction. In this manner, a channel where the exhaust flows in the second direction is provided inside the cylindrical member 71. The channel is defined by the inner circumferential surface of the cylindrical member 71 and the outer circumferential surface of the tail pipe 76.

Since the guide members 78, 79 are mounted between the opening 7*a* and the inlet 76*a* of the tail pipe 76, the exhaust moving mainly in the second direction between the cylindrical member 71 and the tail pipe 76 also moves in the radial direction of the cylindrical member 71, which is orthogonal or substantially orthogonal to the second direction. In detail, the exhaust moving in the second direction between the opening 7*a* and the guide member 78 moves inward in the radial direction near the surface of the guide member 78. Further, the exhaust having passed through the space between the guide member 78 and the tail pipe 76 moves outward in the radial direction near the surface of the guide member 78. Further, the exhaust moving in the second direction between the guide member 78 and the guide member 79 moves outward in the radial direction near the surface of the guide member 79. Further, the exhaust having passed through the space between the guide member 79 and the cylindrical member 71 moves inward in the radial direction near the surface of the guide member 79.

Thereafter, the exhaust having reached the inlet 76*a* of the tail pipe 76 changes the flow direction thereof 90 degrees to flow into the tail pipe 76, and then moves inside the tail pipe 76 in the first direction to be ultimately discharged from the outlet 76*b*.

According to the present preferred embodiment, since a channel where the exhaust flows in the second direction, namely the direction opposite to the first direction, is provided inside the cylindrical member 71, it is possible to ensure a longer length for the entire exhaust channel from the opening 7*a* of the cylindrical member 71 to the outlet 76*b* of the tail pipe 76, and also to reduce the speed of the exhaust flow where the exhaust flow is bent. With the above arrangement, it is possible to improve the exhaust sound reduction capability and the spark prevention capability, and to reduce the size of the spark arrestor 7 and the muffler 6.

According to the present preferred embodiment, since the outer wall of the tail pipe 76 is used as a portion of the channel where the exhaust flows in the second direction, it is possible to reduce the diameter of the spark arrestor 7.

According to the present preferred embodiment, since the opening 7*a* of the cylindrical member 71 is positioned farther in the first direction than the inlet 76*a* of the tail pipe 76, it is possible to ensure a longer length for the entire exhaust channel.

According to the present preferred embodiment, since the guide members 78, 79 are mounted so as to extend across the space between the opening 7*a* of the cylindrical member 71 and the inlet 76*a* of the tail pipe 76, and the exhaust flow is thus bent, it is possible to ensure a longer length for the entire exhaust channel and also to reduce the flow speed of the exhaust flow.

According to the present preferred embodiment, since the guide members 78, 79 guide the exhaust flowing into the cylindrical member 71 from the opening 7*a* and then toward the inlet 76*a* of the tailpipe 76 so as to flow in the radial direction of the cylindrical member 71, which is orthogonal or substantially orthogonal to the second direction, and the exhaust flow is thus bent, it is possible to ensure a longer length for the entire exhaust channel, and also to reduce the flow speed of the exhaust flow.

Although preferred embodiments of the present invention have been described in the above, the present invention is not limited to the above described preferred embodiments, and various modified preferred embodiments are possible for a person skilled in the art.

For example, the cylindrical member 71, the mesh member 72, the cap member 73, the cap member 74, and the inner circumferential portion 743 or the like, which are positioned inside the cylindrical member 71, may be integral and unitary with each other. Further, the opening 7*a* in the cylindrical member 71 may be formed by attaching the cap member 73 to a notch on an end portion of the cylindrical member 71. Further, the tail pipe 76 may extend to the outside through the notch on the end portion of the cylindrical member 71.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A spark arrestor mounted to a muffler connected to an exhaust pipe of an engine, the spark arrestor comprising:

a cylindrical portion including an opening extending therethrough from an outside to an inside of the cylindrical portion, the cylindrical portion including a channel therein;

two caps that respectively close first and second ends of the cylindrical portion;

a mesh portion that covers the opening;

a tail pipe extending from the inside to the outside of the cylindrical portion; and a guide portion extending across a space between the opening and an inlet of the tail pipe; wherein the exhaust flows outside the cylindrical portion in a first direction along an axis of the cylindrical portion, and the exhaust flows in the channel in a second direction opposite to the first direction.

2. The spark arrestor according to claim 1, wherein the channel is arranged between the opening and the inlet of the tail pipe.

3. The spark arrestor according to claim 1, wherein an outer wall of the tail pipe defines a portion of the channel.

4. The spark arrestor according to claim 1, wherein the guide portion is arranged to guide the exhaust flowing from the opening into the inside of the cylindrical portion to a location located in the first direction from the inlet of the tail pipe.

5. The spark arrestor according to claim 1, wherein the opening is positioned in a location located in the first direction from the inlet of the tail pipe.

6. The spark arrestor according to claim 1, wherein a tip end of the guide portion in the first direction is positioned in a location located in the first direction from the opening.

7. The spark arrestor according to claim 1, wherein the opening is positioned in a location located in the first direction from the inlet of the tail pipe.

8. The spark arrestor according to claim 7, wherein the guide portion guides the exhaust in a direction orthogonal or substantially orthogonal to the second direction.

9. A muffler including the spark arrestor according to claim 1.

10. A straddle type vehicle including the muffler according to claim 9.

* * * * *